US006831423B2

(12) United States Patent
Chen

(10) Patent No.: US 6,831,423 B2
(45) Date of Patent: Dec. 14, 2004

(54) HIGH Q IMPEDANCE MATCHING INVERTER CIRCUIT WITH AUTOMATIC LINE REGULATION

(75) Inventor: Timothy Chen, Aurora, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/402,483

(22) Filed: Mar. 28, 2003

(65) Prior Publication Data

US 2004/0189215 A1 Sep. 30, 2004

(51) Int. Cl.[7] ..... H05B 37/02; H05H 7/122

(52) U.S. Cl. ..... 315/224; 315/209 R; 315/291; 363/55; 363/56.01

(58) Field of Search ..... 315/224, 209 R, 315/291, 244, 241 R, 307; 363/55, 55.01–55.05, 95, 56.01, 56.02, 56.03; H05B 37/02; H02H 7/122

(56) References Cited

U.S. PATENT DOCUMENTS

| | | | | |
|---|---|---|---|---|
| 4,254,362 A | | 3/1981 | Tulleners | |
| 4,533,070 A | | 11/1985 | Sairanen et al. | |
| 4,603,378 A | | 7/1986 | Virta | |
| 5,408,403 A | | 4/1995 | Nerone et al. | 363/37 |
| 5,546,300 A | | 8/1996 | Lee et al. | |
| 5,729,175 A | * | 3/1998 | Ferrer | 330/250 |
| 5,796,214 A | | 8/1998 | Nerone | 315/209 R |
| 5,874,810 A | | 2/1999 | Nerone | 315/248 |
| 5,877,595 A | | 3/1999 | Nerone | 315/209 R |
| 6,218,788 B1 | | 4/2001 | Chen et al. | |
| 6,469,919 B1 | * | 10/2002 | Bennett | 363/56.02 |
| 6,472,827 B1 | * | 10/2002 | Nilssen | 315/209 R |

OTHER PUBLICATIONS

Lin Y.L., et al., *Class L–a new single–ended DC–to–AC power inverter*, Applied Power Electronics Conference and Exposition, 1997. APEC '97 Conference Proceedings 1997, Twelfth Annual Atlanta, GA, ISA Feb. 23–27, 1997, pp. 776–782, XP010215750 ISBN: 0–7803–3704–2.

* cited by examiner

*Primary Examiner*—Wilson Lee
*Assistant Examiner*—Trinh Vo Dinh
(74) *Attorney, Agent, or Firm*—Fay, Sharpe, Fagan, Minnich & McKee, LLP

(57) ABSTRACT

An inverter circuit includes an input section configured to receive voltage from a voltage source and to input the voltage to the circuit. A switching network is connected to receive the input voltage from the input section. A controller controls operation of the switching network and load connections are connected to the resonant switching circuit. A variable capacitance network is series-connected to the load connection to provide a variable capacitance during circuit operation.

A method includes passing a supplied voltage to a switching network which is controlled by a controller, and which delivers a lamp voltage to a lamp. A voltage in a capacitor series-connected to the lamp is clamped at predetermined levels, acting to remove a fixed capacitor from the circuit or at least a portion of a cycle of operation of the circuit, wherein an effective variable circuit capacitance is obtained by operation of the clamping action.

20 Claims, 5 Drawing Sheets

HIGH Q IMPEDANCE MATCHING INVERTER CIRCUIT WITH AUTOMATIC LINE REGULATION

BACKGROUND OF THE INVENTION

The present application is directed to inverter circuits used in the powering of discharge lamps, and more particularly to a third order high Q impedance matching inverter circuit with automatic line regulation electronic ballast for use with high power discharge lamps operating on a low input voltage.

Turning to FIG. 1, shown is a known, rapid start, second-order inverter circuit topology used for powering high power, low impedance discharge lamps. Such a circuit will have a 1 to 1.5 second delay between application of a starting signal and lamp ignition. Circuit 10 includes a full bridge input section 12 which receives an input from AC source 14. The output of the full bridge section 12 is provided to a half bridge switching circuit network 16, comprised of a first transistor switch 18, a second transistor switch 20, and a controller 21. Output voltage from the half bridge switching circuit 16 is delivered to a resonant LC network 22, including a resonant inductor 24 and a resonant capacitor 26. The output from LC circuit 22 is provided to a lamp 28, which is further connected to capacitive voltage divider network 30, composed of capacitor 32 and capacitor 34. A starting voltage of approximately 600 volts may be used as the ignition voltage. In this type of circuit, since the striking voltage is commonly only 600 volts, a preheat circuit (not shown) may be included to preheat the lamp prior to supplying the ignition voltage.

A drawback of the circuit depicted in FIG. 1 is that it is not designed to operate efficiently with high impedance lamps. This is due, in part, to the use of lower input voltage. For example, when the input is a standard 120 volts, the circuit bus voltage may be about 150–160 volts. The AC voltage is approximately halved, due to the operation of switching network 18, causing the AC output at the half-bridge switching network 18 to be approximately 75 volts. This voltage is sufficient to efficiently operate a low impedance lamp. However, if the lamp is a high impedance lamp, circuit 10 will need to draw an increased current, causing inefficient operation and stress on the components within the circuit.

Another drawback of the circuit in FIG. 1, is that in order to obtain an acceptable Q rating, if attempting to drive a high impedance lamp, a significantly higher voltage needs to be supplied to the lamp. In this situation, to obtain the desired Q rating, a larger sized resonant capacitor 26 and resonant inductor 24 is needed.

Further, the rapid start circuit 10 of FIG. 1, will maintain the preheat circuit active even after ignition of the lamp, resulting in a loss of about 1 to 1.5 watts of power.

If circuit 10 is attempted to be operated as an instant start lighting system, then the lamp starting voltage will be approximately 1300 volts. This higher voltage will need a higher resonant current, approximately 5 amps. The higher the current, the greater the stress on the inductor 24, requiring a larger sized component. Increasing the size of the magnetics (i.e., inductor 24) increases the cost of the magnetics, and increases the size of the housing in which the magnetics are held. The same switching current will also be seen by the half-bridge switching network 16, which includes transistors 18 and 20. To handle these higher currents, larger sized dies will be necessary, and therefore larger packages for transistors 18 and 20 will be used (the transistors may be FET, CMOS, bipolar or other appropriate transistor type). These larger, more robust transistors and capacitors carry an increased economic cost, require a larger physically sized lamp lighting system, as well resulting in decreased circuit efficiency.

Thus, if the second order inverter circuit 10 of FIG. 2 is attempted to be used to drive high impedance lamps, a large starting current would be needed. It is known that when the starting current is higher, larger magnetics (i.e., inductor 24), and transistors will be needed to handle the higher current, resulting in a less efficient lamp lighting system.

SUMMARY OF THE INVENTION

In accordance with one aspect of the present application, an inverter circuit includes an input section configured to receive voltage from a voltage source and to input the voltage to the circuit. A switching network is connected to receive the input voltage from the input section. A controller is placed in operational connection with the switching network and is designed to control operation of the switching network. A resonant switching circuit is configured to receive an output from the switching network. Load connections are connected to the resonant switching circuit. A variable capacitance network is connected to the load connection to provide a variable capacitance during circuit operation.

In accordance with another aspect of the present application, a method is provided for operating an inverter circuit, including supplying a voltage from a voltage source to an input section. The received voltage is passed from the input section to a switching network. Operation of the switching network is being controlled by a controller, wherein a prescribed voltage is transmitted to a resonant circuit and a lamp voltage is delivered to a lamp connected to the resonant circuit. A voltage in a capacitor is clamped at predetermined levels. The clamping action acts to remove a fixed capacitor from the circuit or at least a portion of a cycle of operation of the circuit, wherein an effective variable circuit capacitance is obtained by operation of the clamping action.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE INVENTION

Figure 1:
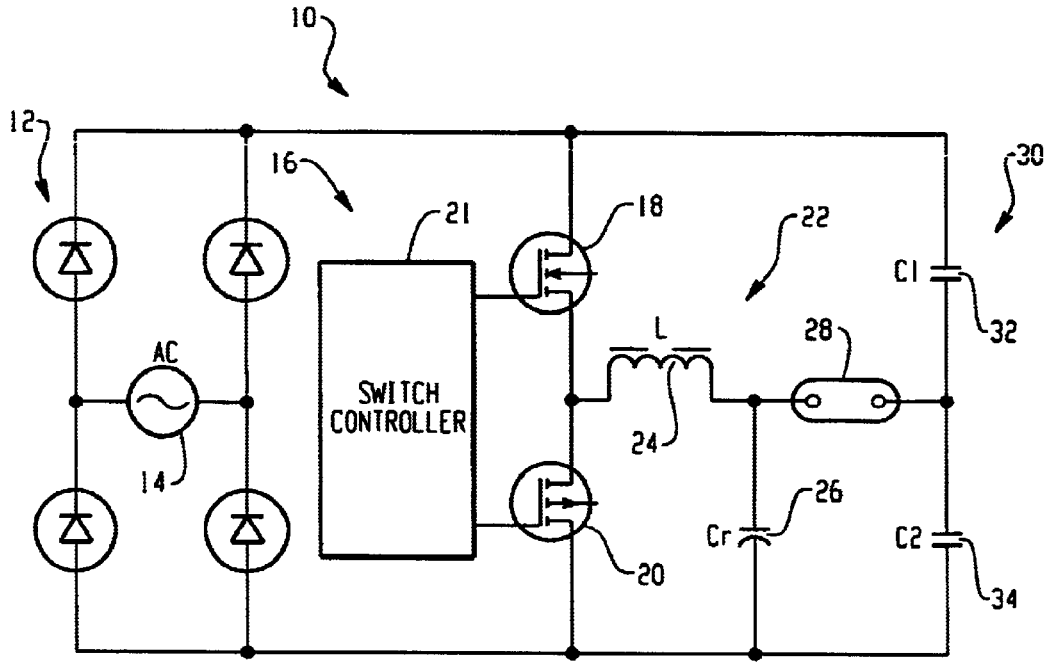
Fig. 1 PRIOR ART
FIG. 1 shows a second-order inverter circuit topology.

The second-order inverter circuit 10 of FIG. 1 may be attempted to be used as a third-order inverter circuit if the values of capacitors 32 and 34 are made much smaller in size, or removed from the circuit. Particularly, when operating as a second-order circuit, the capacitor network 30, including capacitors 32 and 34 act as a voltage divider to the lamp, and to store energy of the circuit. In one embodiment, which uses a 120 volt input, this may be accomplished by using capacitive values above approximately 100 nanofarads. However, if capacitors 32 and 34 are within a range from approximately 100 nanofarads down to about 5 nanofarads, the capacitor network 30 acts not only as a voltage divider/energy storage circuit, but it also becomes part of the resonant circuit (including resonant inductor 24 and resonant capacitor 26). This will change the circuit of FIG. 1 from a second-order inverter circuit to a third-order inverter circuit.

However, a circuit configured in this manner will have poor regulation during operation. For example, with an input voltage change of 10 percent, the power change may be from 20 to 25 percent. This instability continues to increase as the changes in the circuit input increase, causing stress on the circuit components, and wasting of energy. Additionally, operating the circuit 10 of FIG. 1 as a third-order inverter will result in a circuit highly sensitive not only to voltage input fluctuations but also to component variations. Particularly, a component out of specification, or even within the tolerance rating, may undesirably vary circuit operation. To control the undesirable variations, complex controls implementing IC controllers or other components would be needed to obtain some circuit stability. These drawbacks have limited practical applications of a third-order inverter operation for a circuit designed as shown in FIG. 1 in low-cost environments. This again is due to the sensitivity of the circuit to powerline variations, component variations, as well as impedance variations.

However, it is understood from this discussion that a third-order circuit has desirable aspects, including the benefit of being able to efficiently drive a high impedance lamp, with a low starting current. This is, in part, due to the use a resonant capacitance, much smaller than used in a second order circuit. The smaller capacitances result in smaller current values, which permit the use of a smaller inductor 24 and transistors 18 and 20.

Figure 2:
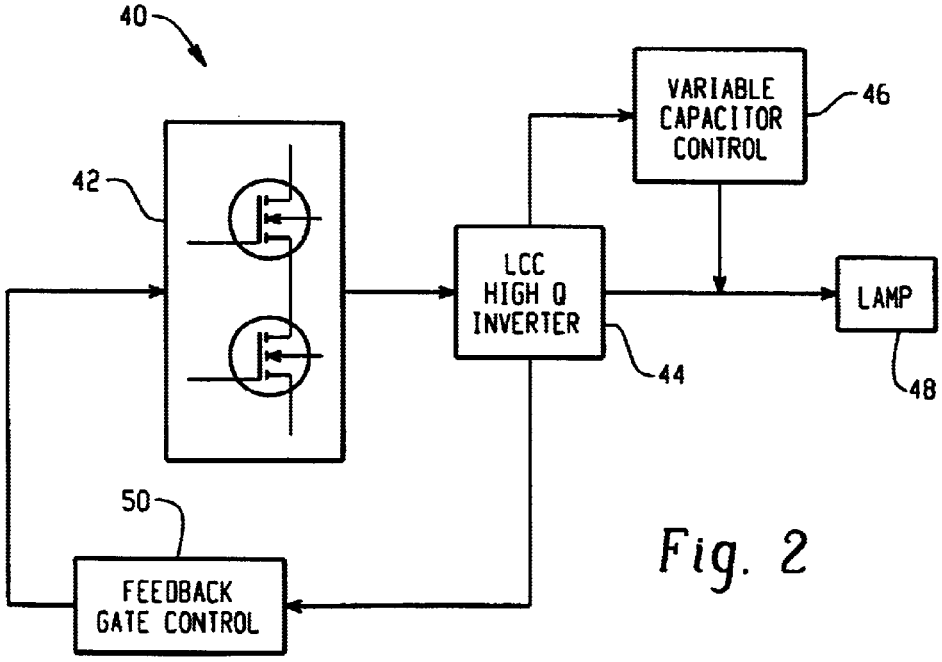
FIG. 2 is a block circuit diagram of a circuit in accordance with the concepts of the present application.

Turning to FIG. 2, depicted is a circuit block diagram 40 which represents a third-order inverter circuit according to the concepts of the present application. Signals, such as from a full bridge diode bridge (not shown) or other appropriate network, are delivered to a switching circuit block 42. This switching network may be a single, half-bridge, full-bridge or other appropriate network designed to implement the concepts of the present application. Circuit block 42 provides a voltage to an inductor/capacitor/capacitor high Q inverter block 44. The capacitors of block 44, have significantly smaller values than the capacitors in a second order system.

The capacitive network of block 44 is designed to provide a variable capacitance as identified in variable capacitor control block 46. By this configuration, ascribed values of voltage, power and current are delivered to a high impedance load 48 such as a high impedance lamp. The network of block 44, also provides feedback signals to feedback gate control block 50, used to control operation of the circuit within designed parameters. Variable capacitor control block 46 compensates for line voltage input or other component changes of the circuit, improving power regulation provided to load 48. An operational concept of circuit block diagram 40 is to cause a capacitor component having a fixed value to act as an effective variable circuit capacitance over the cycle of circuit operation.

Figure 3:
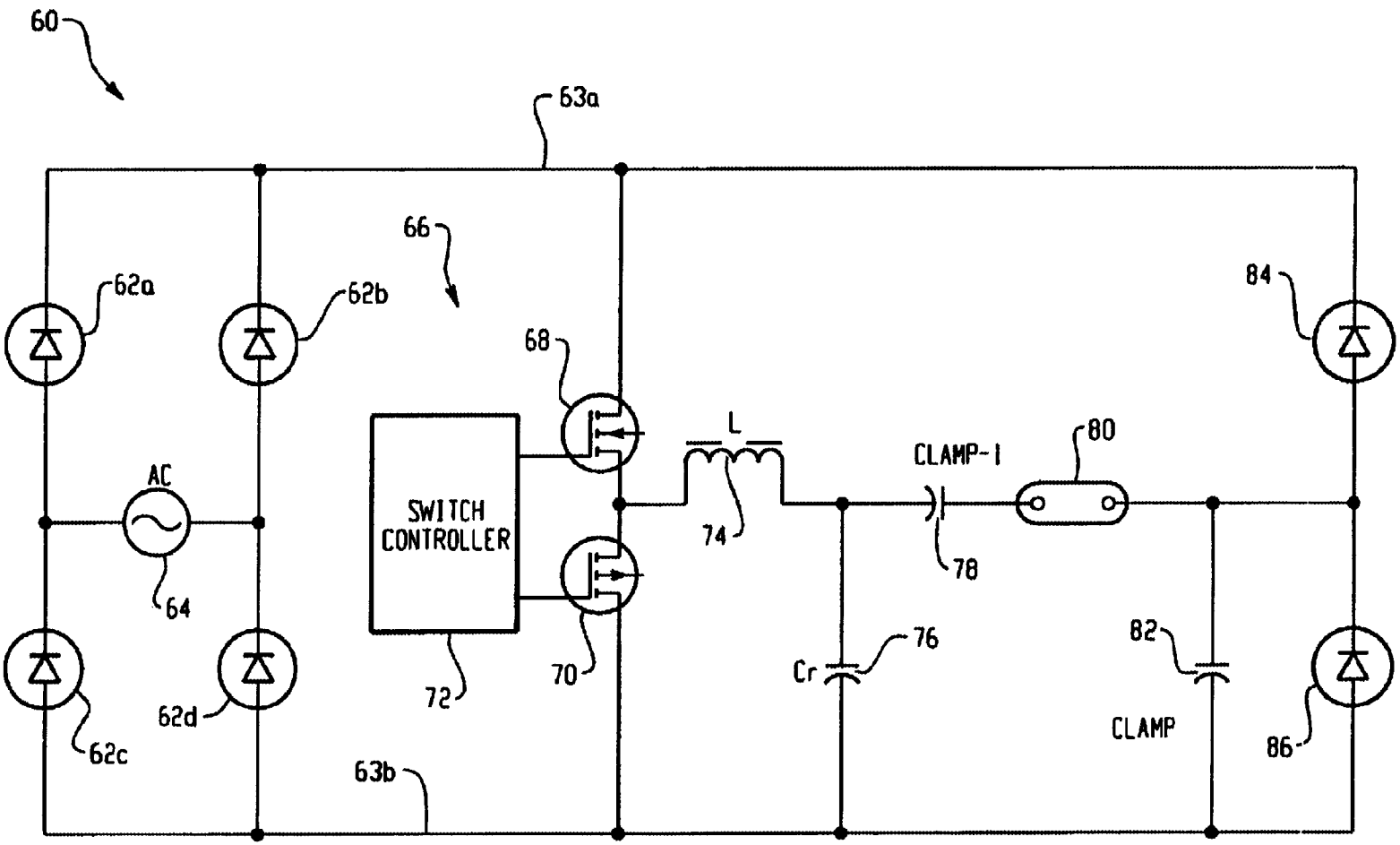
FIG. 3 is a first embodiment of a circuit topology for a third-order inverter circuit with automatic line regulation in accordance with the present application.

Turning to FIG. 3, illustrated is a third-order inverter circuit 60 with automatic line regulation in accordance with concepts of the present application. This design maintains many of the characteristics of the previously discussed circuit 10. However, the present circuit design permits the efficient driving of a high-impedance lamp with a low starting current, as well as providing a low operating current, in a circuit having stable operation.

Circuit 60 includes a full-bridge rectifier, comprised of diodes 62*a*, 62*b*, 62*c* and 62*d*, connected to positive bus 63*a*, and common bus 63*b*, and supplied via an input source 64. A switching circuit 66 is shown in this figure as a half-bridge network with a first transistor 68 and a second transistor 70, controlled via a controller 72. It is to be appreciated that, while the switching network in the following embodiments are shown as a half-bridge designs, these embodiments are equally applicable and are intended to encompass other input arrangements, including single and full-bridge switching networks, with a variety of control mechanisms. Therefore, switching circuit block 42 of FIG. 2 is intended to represent a variety of the known switching elements and control mechanisms.

As previously discussed, the output voltage generated by switching circuit 66 is supplied to a resonant circuit including of resonant inductor 74, and resonant capacitor 76. A second resonant capacitor 78 is connected in series with a load 80, such as a high impedance lamp connected in the circuit by load connections 80*a*, 80*b*. The present circuit further includes an impedance matching capacitor 82 also in series with lamp 80. Matching capacitor 82 which may also be considered part of the resonant circuit acts to increase the Q factor of the circuit without the need for a higher value for resonant capacitor 76, as would for example be needed in a second-order inverter circuit. Therefore, the starting current, is reduced allowing the use of smaller sized inductors and capacitors than otherwise possible.

However, it is appreciated that during operation, this high Q circuit 60 would be sensitive to line voltage and system component variations. To address these issues, circuit 60 employs impedance matching capacitor 82 to provide an effective variable capacitance, even though it has a fixed capacitor value. This is accomplished through the use of switching elements 84 and 86 in combination with impedance matching capacitor 82. Switching element 86 is placed in parallel with impedance matching capacitor 82 and switch 84 is connected at one end to switch 86 and at its other end to the positive bus of circuit 60. In one embodiment, switches 84 and 86 may be to high-speed, fast-recovery diodes.

Figure 4:
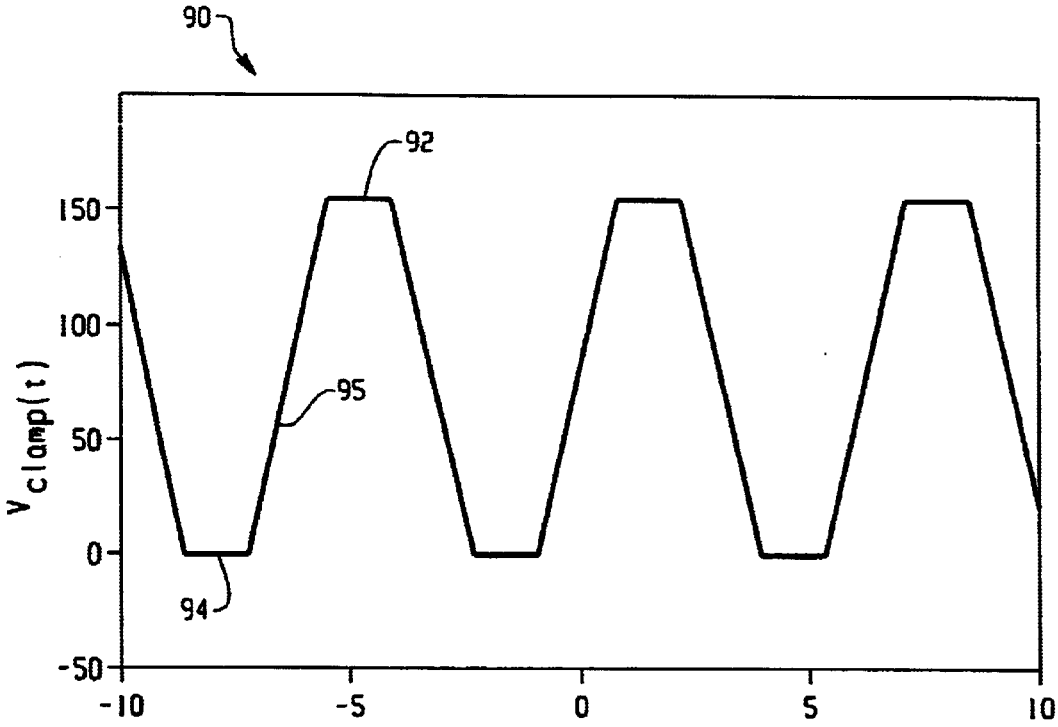
FIG. 4 is the voltage across a capacitor in the circuit of the present application to illustrate a lamp's current sensitivity in the present circuit.

Turning to FIG. 4, depicted is a graph illustrating a current sensitivity analysis of the lamp in accordance with the circuit shown in FIG. 3, and the effect of the arrangement of matching capacitor 82 and diodes 84, 86. Voltage waveform 90 depicts the voltage across capacitor 82.

As may be observed, waveform 90 is clamped at its positive going side 92 at approximately 150 volts, and at its negative going side 94 at approximately 0 volts. Particularly, waveform 90 is clamped to common on its negative side and to the positive bus voltage on its positive side. During operation in the linear range 95, capacitor 82 acts as a component with a fixed capacitive value. Above the range from about 150 volts or below the range from about 0 volts, capacitor 82 is essentially removed from circuit operation. By this design, over an entire cycle of operation, an effective variable capacitive value is obtained.

When higher or lower current goes through capacitor 82, this will indicate that higher or lower current is also going through the lamp. The lamp current and capacitor current are the same (assuming the diodes 84 and 86 are not clamping the circuit) since the capacitor 82 is in series with lamp 80. Therefore, the current in the lamp 80 changes as the line voltage changes, or as component variations occur.

These variations also result in the voltage across the capacitor 82 changing. When the voltage across capacitor 82 diodes 84, 86 reaches a predetermined amount (e.g., 150 or 0 v), diodes 84, 86 clamp the voltage across capacitor 82. Once the diodes 84 and 86 clamp capacitor 82, it is effectively bypassed during that portion of the conduction time. By this action, the circuit substantially automatically changes the equivalent capacitor value of the circuit. Thus, the capacitor 82 and diodes 84 and 86 function as a variable capacitance control circuit, such as block 46 of FIG. 2. This capacitance adjustment feature reduces the sensitivity of the circuit to variations, such as the mentioned input voltage variations or variations due to components.

A reason the described process is effective is because every line change, inductor change, capacitor change, frequency change, translate or have an effect on the lamp current, causing it to change. By controlling lamp current, it is possible to make the circuit less sensitive to such variations. This design and process permits regulation similar to that as may be obtained by a second-order inverter circuit, while gaining the benefits of a third-order circuit, such as the applicability to high-impedance lamps, use of low starting current, and high starting voltage, less stress on the components, as well as being able to construct a device with a smaller physical footprint due to the use of smaller sized components. This design also gains the benefits of a third-order inverter by having a higher efficiency operation than the second order inverter circuits when driving high impedance lamps.

As previously mentioned, the current through the lamp is dependant upon various factors. The following formula illustrates this concept:

$$\Delta I_{Lamp} = \left(\frac{d}{dL} I_{Lamp}\right)\cdot \Delta L + \left(\frac{d}{dC_{Lamp}} I_{Lamp}\right)\cdot \Delta C_{Lamp} + \left(\frac{d}{dR_{Lamp}} I_{Lamp}\right)\cdot \Delta R_{Lamp}$$

Particularly, the formula emphasizes that total lamp current change ($\Delta I_{Lamp}$) is comprised of three components. The first component is the lamp current change ($dI_{Lamp}$) versus the resonant inductor change (dL) of the total change in inductance ($\Delta L$). The second component consists of the lamp current change ($dI_{Lamp}$) versus the resonant capacitor change ($dC_{Lamp}$) for the total resonant capacitive change ($\Delta C_{Lamp}$). The third component is the current lamp change ($dI_{Lamp}$) versus the lamp impedance change ($dR_{Lamp}$) for a total lamp change ($\Delta R_{Lamp}$). The impedance change in the lamp may be due to manufacturing variabilities of particular lamps where lamps may change from lot to lot, or even from lamp to lamp, in their inherent impedance.

Figure 5:
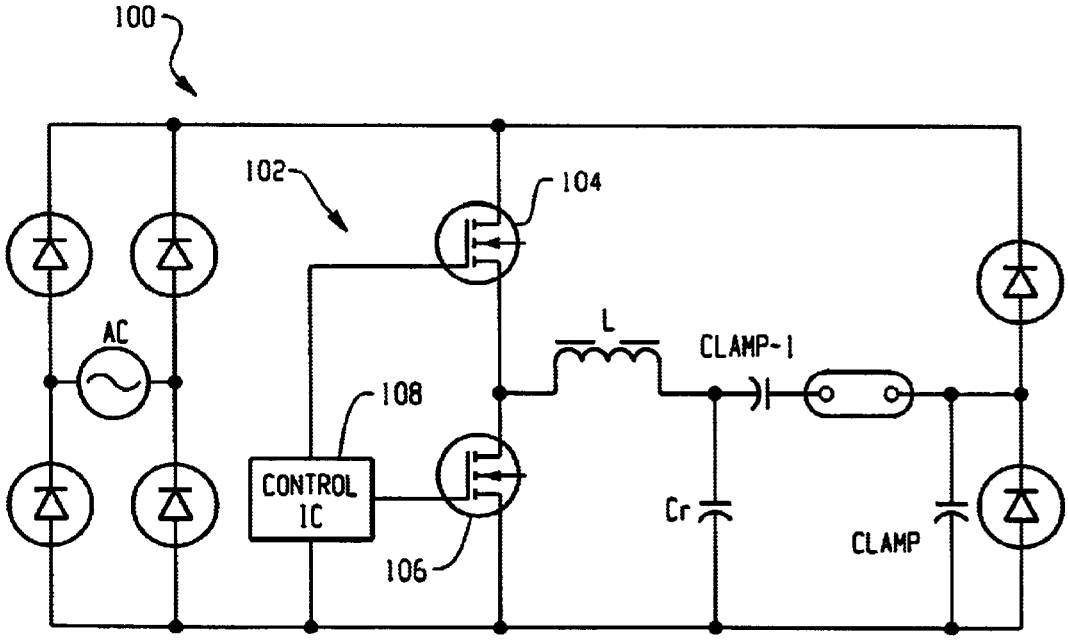
FIG. 5 shows a second embodiment of a third-order inverter circuit with integrated circuit control for open- or closed-loop operation.

Turning to FIG. 5, illustrated is a second embodiment of a third-order inverter circuit 100. In this design, the switching network 102 uses two FETs 104, 106 controlled by an integrated control circuit 108. The integrated control circuit 108 permits the design to operate as either an open loop or a closed loop system. The remaining components of the system are similar to that of circuit 60 in FIG. 3.

Figure 6:
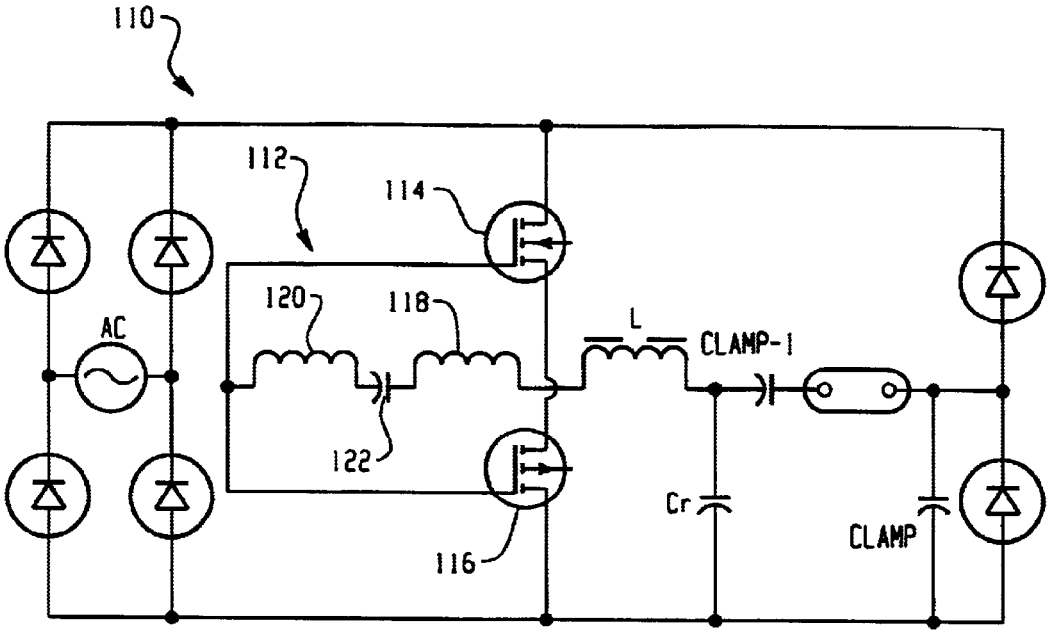
FIG. 6 depicts a third embodiment of a third-order inverter circuit with a complementary pair of FETs.

Turning to FIG. 6, a third embodiment of a third-order inverter circuit 110 includes a switching network 112, which is a complementary switching circuit design implementing a complementary pair of switches (e.g., FETs) 114, 116, driven via an input of inductors 118, 120 and capacitor 122 (alternative designs of the complimentary pair switching are shown in U.S. Pat. Nos. 5,408,403; 5,796,214; 5,874,810; and 5,877,595 to Nerone et al., each hereby incorporated by reference in their entirety). This topology illustrates a self-oscillating, low cost system design. The remaining circuit portions are similar to the circuit of FIG. 3. It is noted that inductor coil 118 is also part of the resonant circuit design.

Figure 7:
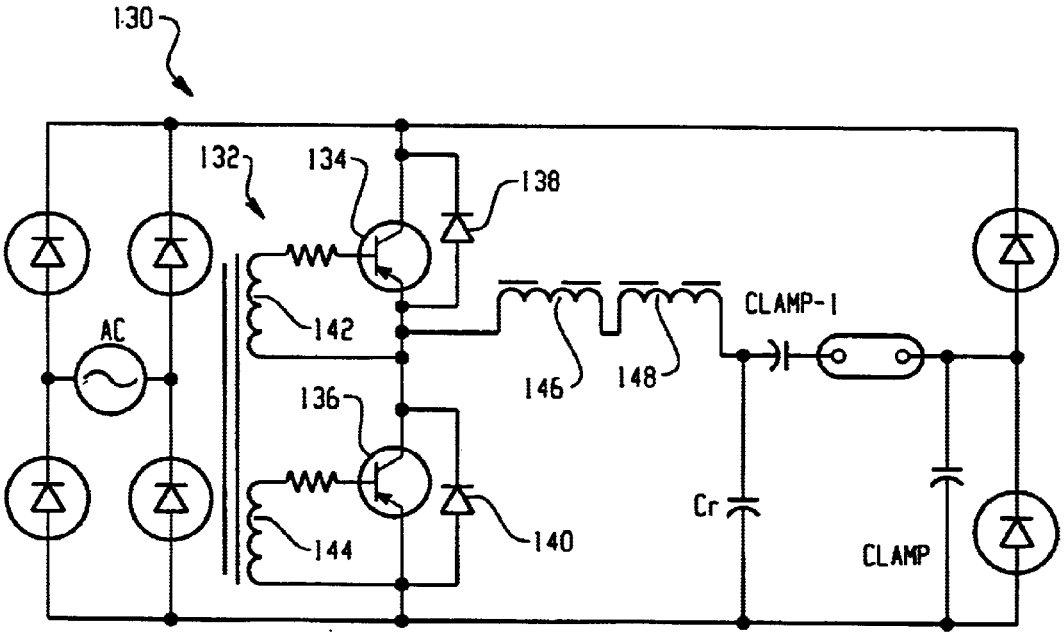
FIG. 7 depicts a fourth embodiment of a third-order inverter circuit employing bipolar transistors.

Turning to FIG. 7 illustrated is a fourth embodiment of a third-order inverter circuit 130, which uses bipolar transistors as the switching elements. Particularly, drive circuit 132 includes bipolar transistors 134, 136 and diodes 138, 140 attached across each respectively. Transistors 134 and 136 are driven via inductor coils 142, 144, which are in electrical communication to inductor coils 146.

Figure 8:
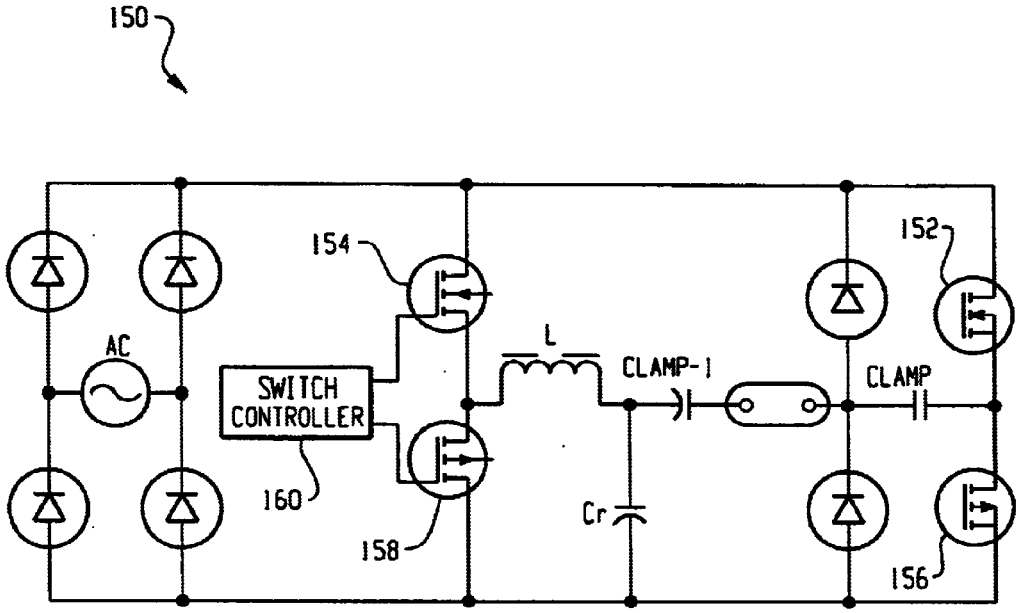
FIG. 8 depicts a full-bridge switching network circuit in accordance with the concepts of the present application.

Turning to FIG. 8, illustrated is a further embodiment of a circuit 148 in accordance with the present application, wherein the switching network 150 is particularly defined as having a full-bridge switching network consisting of transistors 152, 154, 156 and 158. The controller is shown as a generic controller 160, which may be any of the previously described or other existing controllers used to operate a full-bridge network. This design would allow for a much higher power operation such as 1 kw.

Figure 9:
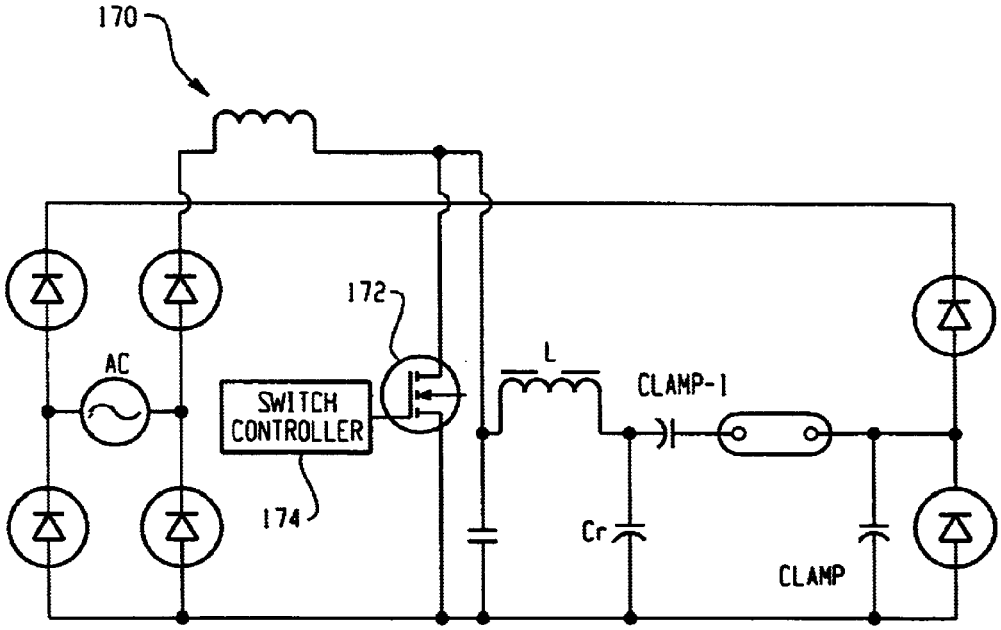
FIG. 9 depicts a single switch network incorporating the concepts of the presents application.

FIG. 9 illustrates a circuit 168 similar to those previously described with a switching network 170 designed for a single switch 172 controlled by a controller 174.

The third-order inverter circuit embodiments illustrated in FIGS. 3 and 5–9, as well as the block circuit diagram of FIG. 2, describe circuits where effective variable capacitance values are obtained from a fixed capacitor value and act as a feedback control (i.e., block 50 of FIG. 2) to stabilize circuit operation. Particularly, the capacitor adjustments are operationally opposite to variations of the input to the circuit and/or the circuit components. For example, when positive voltage changes occur (i.e., voltage increases) above a certain value, the variable capacitance acts to negate this change and/or other component changes. Action of the effective variable capacitance created by capacitor 82, diodes 84 and 86, combination function to counteract circuit fluctuations (i.e., increases/decreases). In this manner, the system is provided with a negative feedback control, which inherently has a stabilization feature.

Operation of the third-order inverter circuits of the present application increases the Q factor obtainable by this design to a range of 2–5, whereas the Q factor operation in a second-order system would substantially be a 1 to 1.5 range. Also, the physical size of a light system (such as a compact fluorescent lamp) maybe decreased by as much as 30 percent as compared to compact fluorescent lamp systems implementing existing inverter circuit designs. For one example, while the values of inductors used in second-order and third-order inverter circuits powering similar sized lamps may be substantially the same, the second-order systems would need to carry potentially twice as much current as the presently disclosed circuits, therefore, a larger core size would be necessary. Further, the diameter of the glass envelope for such a compact fluorescent lamp system, and the spacing between the loops of the glass envelope may also be significantly smaller than that for existing lamps, due to the features described herein.

While the present system may be embodied in a number of different alternatives, and with different values, in one embodiment implementing a half-bridge rectifier system such as maybe known in the art, used at a 125 volt input, specific values for one particular implementation such as shown in FIG. 3, would include:

| | |
|---|---|
| Diodes 62a, 62b, 62c, 62d | 1N5395 |
| Switch 68 | FQU 9N25 |
| Switch 70 | FQU 9N25 |
| Inductor 74 | 470uh |
| Capacitor 76 | 6.8nf |
| Capacitor 78 | 22nf |
| Lamp 80 | 42W |

-continued

| | |
|---|---|
| Capacitor 82 | 10nf |
| Diode 84 | 1N4937 |
| Diode 86 | 1N4937 |

Other numbered components set forth in this application but not included in this listing may have values similar to those described. It is to be understood the provided values are given simply as examples and are not intended to be limiting of the claims. The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. An inverter circuit comprising:

an input section configured to receive a voltage from a voltage source and to input the voltage to the circuit;

a switching network connected to receive the input voltage from the input section;

a controller in operational connection with the switching network and designed to control operation of the switching network;

a resonant circuit configured to receive an output from the switching network;

load connections connected to the resonant circuit, to provide current to a load connected to the load connections during circuit operation; and a variable capacitance network connected to the load connection in series with the load to provide a variable capacitance during circuit operation.

2. The inverter circuit according to claim 1, wherein the variable capacitance network includes a fixed value capacitor connected in series with the load, a first diode connected in parallel with the fixed value capacitor and a second diode connected in series with the first diode, the series connected first diode and second diode further connected to a common bus and a positive bus.

3. The inverter circuit according to claim 2, wherein the fixed value capacitor has a fixed capacitance value of between approximately 1 nanofarads to 100 nanofarads.

4. The inverter circuit according to claim 1, wherein the switching network includes at least one of a FET, or bipolar transistor.

5. The inverter circuit according to claim 1, wherein the switching network is a single transistor switch.

6. The inverter circuit according to claim 1, wherein the switching network is a half-bridging transistor network.

7. The inverter circuit according to claim 1, wherein the switching network is a full-bridge transistor network.

8. The inverter circuit according to claim 1, wherein the controller is an integrated circuit controller.

9. The inverter circuit according to claim 1, wherein the controller is a complimentary paired controller for controlling a complementary pair of transistor switches.

10. The inverter circuit according to claim 1, wherein the controller is a bi-polar controller network.

11. The inverter circuit according to claim 1, wherein the variable capacitance network is a negative feedback circuit.

12. The inverter circuit according to claim 1, wherein the load connections are configured to connect a high impedance lamp into the circuit.

13. A method of operating an inverter circuit comprising:

supplying a voltage from a voltage source, to an input section;

passing an input voltage from the input section to a switching network;

controlling operation of the switching network by a controller, wherein a prescribed voltage is transmitted to a resonant circuit;

delivering a load voltage to a load connected to the resonant circuit, the load further connected in series with a fixed capacitor; and clamping a voltage across the fixed capacitor at predetermined levels, the clamping action bypassing the fixed capacitor for at least a portion of a cycle of operation of the circuit, wherein an effective variable circuit capacitance is obtained by operation of the clamping action.

14. The method according to claim 13, wherein the fixed capacitor is part of the resonant circuit, when it is not removed by the clamping action.

15. The method according to claim 14, wherein operation of the fixed capacitor in a non-clamping state is at its fixed capacitive value.

16. The method according to claim 15, wherein the clamping action is obtained by a first diode in parallel with the fixed capacitor and a second diode in series with the first diode.

17. The method according to claim 16, wherein operation of the fixed capacitor, first diode and second diode provide a negative feedback signal for the circuit.

18. A variable capacitance network having an equivalent capacitor value comprising:

a fixed capacitor, having a fixed capacitance value, connected in series with a load, the load connected to an output at a first connection and to a first bus at a remaining connection; and a switching arrangement connected in a series/parallel arrangement with the fixed capacitor, wherein the switching arrangement bypasses the fixed capacitor when a first or second predetermined voltage exists at the first connection, thereby changing the equivalent capacitor value of the variable capacitance network when the fixed capacitor is bypassed.

19. The network according to claim 18, wherein the switching arrangement includes a first diode connected in parallel with the fixed capacitor and a second diode connected in series with the first capacitor between the first bus and a second bus.

20. The network according to claim 18, wherein the fixed capacitor and switching arrangement comprise a negative feedback circuit.

* * * * *